US011255177B2

(12) United States Patent
Kopecky et al.

(10) Patent No.: US 11,255,177 B2
(45) Date of Patent: Feb. 22, 2022

(54) CHARACTERIZATION OF DOWNHOLE GAS HANDLING SYSTEMS

(71) Applicant: Halliburton Energy Services, Inc., Houston, TX (US)

(72) Inventors: Trevor Alan Kopecky, Owasso, OK (US); Donn J. Brown, Broken Arrow, OK (US); Bryan Don Mullins, Claremore, OK (US); Vance Lee Fielder, Dewey, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 283 days.

(21) Appl. No.: 16/705,517

(22) Filed: Dec. 6, 2019

(65) Prior Publication Data

US 2021/0172310 A1 Jun. 10, 2021

(51) Int. Cl.

| | |
|---|---|
| ***E21B 43/38*** | (2006.01) |
| ***E21B 43/30*** | (2006.01) |
| ***G01F 1/74*** | (2006.01) |
| ***G01F 15/08*** | (2006.01) |
| ***G01F 7/00*** | (2006.01) |

(52) U.S. Cl.
CPC ..... *E21B 43/38* (2013.01)

(58) Field of Classification Search
USPC ..... 73/152.29
See application file for complete search history.

(56) References Cited

U.S. PATENT DOCUMENTS 5,211,842 A 5/1993 Tuss et al.
6,234,030 B1 * 5/2001 Butler ..... E21B 21/06 73/861.04
9,216,367 B1 12/2015 Caldwell
9,810,042 B1 * 11/2017 Rivas Romero ..... E21B 43/128
2010/0281950 A1 * 11/2010 Weres ..... G01N 1/2202 73/31.07
2011/0132072 A1 6/2011 Houssais
(Continued)

FOREIGN PATENT DOCUMENTS

EP 2749334 B1 10/2018
KR 1020170003178 A 9/2017

OTHER PUBLICATIONS

International Search Report and Written Opinion for PCT application PCT/US2019/065108 dated Sep. 4, 2020, 7 pages.

*Primary Examiner* — Matthew Troutman
*Assistant Examiner* — Douglas S Wood
(74) *Attorney, Agent, or Firm* — Locke Lord LLP

(57) ABSTRACT

An apparatus for testing of downhole multiphase fluid handling systems used in oil and gas production allows test personnel to visually observe the testing. The apparatus is constructed from housings and/or casings made partly or entirely of a see-through material. The see-through material allows for unaided visual observation of the flow regime of the fluid flowing through fluid handling equipment. This eliminates most all of the assumptions that typically need to be made about how well the equipment operates. The ability to clearly observe the flow regimes unassisted allows for accurate study of individual equipment effects, vortices interactions and formation, the effects of different velocities of fluid flow, the optimization of flow paths, remixing and flow regimes external of a system, slug creation, and other parameters known to those skilled in the art.

20 Claims, 6 Drawing Sheets

(56) References Cited

U.S. PATENT DOCUMENTS

| | | | | |
|---|---|---|---|---|
| 2015/0185064 | A1* | 7/2015 | Korobkov | G01N 7/10 702/50 |
| 2017/0261357 | A1* | 9/2017 | Wang | G01F 1/584 |

* cited by examiner

CHARACTERIZATION OF DOWNHOLE GAS HANDLING SYSTEMS

TECHNICAL FIELD

The exemplary embodiments disclosed herein relate to production of oil and gas from a wellbore and, more particularly, to apparatuses and methods for analyzing and testing downhole multiphase fluid handling systems used in such oil and gas production.

BACKGROUND

In the oil and gas industry, fluids from a subterranean formation typically contain a multiphase mixture of oil, gas, water, and other liquids. Production of the oil and gas involves pumping the multiphase mixture up the wellbore, separating the different phases, and transporting them through pipelines for processing downstream. Separation is done using a multiphase fluid handling system comprised of various fluid handling equipment, such as gas separators, pumps, valves, and the like, strategically positioned at certain points both downhole in the wellbore and at the surface. Understanding the effects of the fluid handling equipment on the fluid's flow regime, including flow velocity, whether the flow is laminar or turbulent, and the like, is important in being able to design efficient multiphase fluid handling systems.

Existing techniques for testing the effects of multiphase fluid handling equipment typically entail putting the equipment into a two-phase test loop. The two-phase test loop is designed for testing downhole gas handling equipment and thus is usually constructed from steel or metal casing. Various sensors and instruments are positioned in the test loop to monitor fluid flow through the gas handling equipment and thereby understand the flow and performance characteristics thereof. These sensors and instruments allow those skilled in the art to make educated assumptions about the effectiveness and/or hindrance of the equipment with respect to the flow regimes. While these assumptions are sufficient in many instances, a high probability of error exists due to the complexity of multiphase fluid density differences, the interactions of the multiple phases, and how individual equipment actually affects the flow regime at different velocities.

Therefore, a need exists for improvements in the analysis and testing of downhole multiphase fluid handling systems used in oil and gas production.

BRIEF DESCRIPTION OF THE DRAWINGS

For a more complete understanding of the exemplary disclosed embodiments, and for further advantages thereof, reference is now made to the following description taken in conjunction with the accompanying drawings in which.

DESCRIPTION OF EXEMPLARY EMBODIMENTS

The following discussion is presented to enable a person ordinarily skilled in the art to synthesize and use the exemplary disclosed embodiments. Various modifications will be readily apparent to those skilled in the art, and the general principles described herein may be applied to embodiments and applications other than those detailed below without departing from the spirit and scope of the disclosed embodiments as defined herein. Accordingly, the disclosed embodiments are not intended to be limited to the particular embodiments shown, but are to be accorded the widest scope consistent with the principles and features disclosed herein.

Embodiments of the present disclosure provide an apparatus and method for testing multiphase (e.g., two-phase) fluid handling systems that allow test personnel to visually observe the fluid handling equipment therein. The apparatus is constructed from housings and/or casings made partly or entirely of a see-through material. The see-through material, which can include a transparent (i.e., clear and translucent) material herein, advantageously allows for unaided visual observation of the flow regime of the fluid flowing through the fluid handling equipment. This eliminates most all of the assumptions that typically need to be made about how well the equipment operates. In some embodiments, the same sensors and instruments typically used in steel or metal test loops may be incorporated into the see-through housings as well. The ability to clearly observe the flow regimes unassisted allows for accurate study of individual equipment effects, vortices interactions and formation, the effects of different velocities of fluid flow, the optimization of flow paths, remixing and flow regimes external of a system, slug creation, and other parameters known to those skilled in the art. In short, embodiments of the present disclosure allow for the re-creation of virtually all aspects of an operational oil well in a visually observable test environment.

In addition to the use of various see-through housings and other components, embodiments of the disclosure also provide an arrangement of components that allows for enhanced flexibility in separating and controlling oil and gas flows.

Figure 1A:
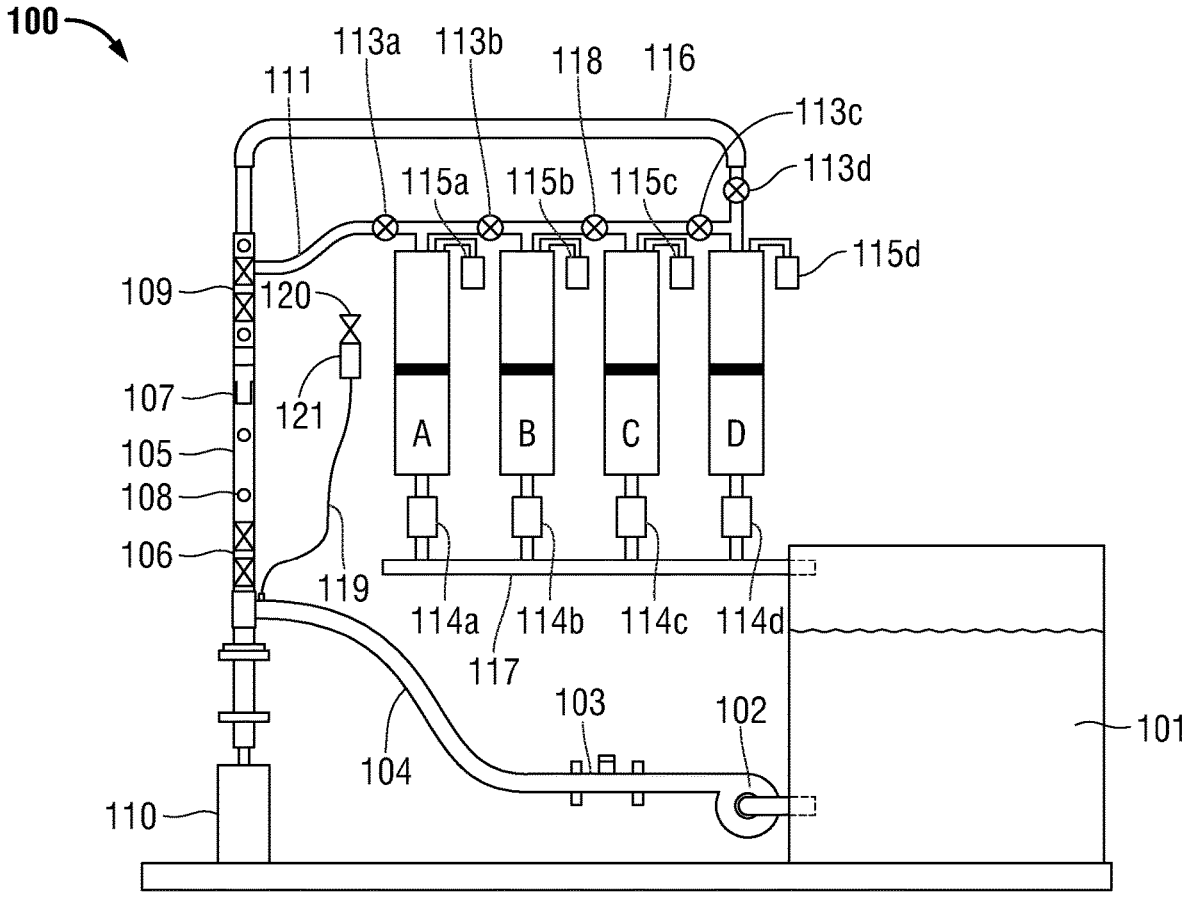
FIGS. 1A-1D are schematic diagrams showing an apparatus for analyzing fluid flow through downhole fluid handling systems according to embodiments of the present disclosure.

Referring now to FIG. 1A, an apparatus 100 for visually observing and determining the characteristics of fluid flow through oil and gas handling equipment according to embodiments of the disclosure is shown. The apparatus 100 includes a fluid holding tank 101. Fluid holding tank 101 provides the source fluid for the apparatus 100 that may be used for testing purposes. Near the bottom of fluid holding tank 101 is an outlet (not expressly labeled) that is connected to a boost pump 102. Boost pump 102 pumps the source fluid from holding tank 101 through a flow meter 103 and into a system supply pipe 104. System supply pipe 104 carries the source fluid to a test stand pipe 105.

Test stand pipe 105 simulates a tubing or casing in a wellbore or a pipeline in the analysis of a fluid handling system. To model the tubing, casing, or pipeline, test stand pipe 105 resembles or takes the form of a generally hollow cylindrical housing having a generally uniform thickness defining a generally straight flow path therethrough. In accordance with embodiments of the disclosure, the cylindrical housing/test stand pipe 105 is constructed partly or entirely of a see-through material. Suitable material that may be used for the test stand pipe 105 include Plexiglas, Lucite, and other transparent plastics known to those skilled in the art as well as glass materials. The term "transparent" is used herein to also encompass translucent materials.

Test stand pipe 105 houses various fluid handling equipment, such as fluid flow separators and pumps, that are desired to be characterized in connection with the flow of fluids through a fluid handling system. In the embodiment shown, test stand pipe 105 is provided with a mechanical gas separator 106. Mechanical gas separator 106 may be a two-stage separator that creates a vortex within the fluid being supplied from holding tank 101 through system supply pipe 104. Test stand pipe 105 is also provided with gas separator 107 located between mechanical gas separator 106 and an upstream multistage pump 109. Pump 109 may have any suitable number of pump stages, such as a two-stage pump, as shown in the example embodiment. In some embodiments, a motor drive 110 coupled to test stand pipe 105 drives or otherwise provides power to the pump 109 and other fluid handling equipment in the test stand pipe 105.

Gas separator 107 functions to remove or separate gas from the fluid in the test stand pipe 105 to prevent gas from entering the upstream multistage pump 109. Gas separator 107 is considered to be functioning properly if no gas from the fluid flow enters pump 109. Several different gas separator designs exist and may be tested in test stand pipe 105. In the present example, gas separator 107 uses a design where gas exits into an annulus (not expressly shown) between an inner wall of test stand pipe 105 and gas separator 107. In preferred embodiments, one or more of gas separator 107, multistage pump 109, and mechanical gas separator 106 also have an outer housing that is constructed partly or entirely of a transparent material to enable visual observation thereof.

A first chamber supply line 111 is connected to the test stand pipe 105 at or near the annulus where gas exits gas separator 107. The first chamber supply line 111 transports the separated gas along with any fluid in the annulus to a series of four chambers, labeled A, B, C, and D, respectively. The first chamber supply line 111 thus represents or simulates a gas discharge path for gas separated from a multiphase fluid by gas separator 107. A second chamber supply line 116 is connected to the test stand pipe 105 upstream of pump 109. The second chamber supply line 116 transports fluid flowing through pump 109 along with any unseparated gas to the chambers A, B, C, and D. In the present example, supply line 116 represents a well head path from the output of the multistage pump 109 as it would be arranged in actual production operations. In preferred embodiments, each of the first and second chamber supply lines 111 and 116 and the chambers A, B, C, and D is constructed partly or entirely of a transparent material.

Fluid from holding tank 101 may be pumped through test stand pipe 105, first and second chamber supply lines 111 and 116, and into one or more of the chambers A, B, C, and D, respectively. The chambers A, B, C, and D are provided with four chamber valves 113*a*-113*d* positioned in the first and second chamber supply lines 111 and 116 as shown. These chamber valves 113*a*-113*d* can be individually opened and closed in conjunction with each other to control the supply of fluid into one or more of the chambers A, B, C, and D. The height of the fluid level in each of the chambers A, B, C, and D may be controlled as desired during operation of the apparatus 100 by adjusting the flow rate from boost pump 102.

Each of the chambers A, B, C, and D is also provided with an outlet (not expressly labeled) that is connected to a return line 117 for returning fluid to holding tank 101. Fluid flow meters 114*a*-114*d* mounted at the fluid outlets measure the flow rate of liquid flowing through each individual chamber A, B, C, and D, respectively, as fluid from each chamber returns through return line 117 back to holding tank 101.

Each chamber A, B, C, and D is also provided with a gas outlet (not expressly labeled) near the top of each chamber. Gas carried by first supply line 111 or second supply line 116, or both, to the chambers A, B, C, and D subsequently exits each chamber A, B, C, and D through the outlets. The exiting gas passes through a respective gas flow meter 115*a*-115*d* that measures the gas flow rate of the gas exiting from each chamber A, B, C, and D.

The apparatus 100 is also provided with an isolation valve 118 between the middle two chambers B and C. Isolation valve 118 is operable to isolate and divide the four chambers A, B, C, and D into two pairs, one pair composed of the first and second chambers A and B and another pair composed of the third and fourth chambers C and D. This allows the chambers to be operated as sets of pairs, as will be described further herein. Further, apparatus 100 is provided with gas supply line 119 that allows gas to be injected into the test stand pipe 105. A valve 120 allows an operator to control the injection rate at which gas is injected into the test stand pipe 105. A gas flow meter 121 is provided to allow measurement of the flow rate of the gas flowing through gas supply line 119.

It will be appreciated that the number of chambers A, B, C, and D is adjustable for a particular application. Thus, chambers may be removed or added as needed such that fewer than four (e.g., three, two, etc.) chambers or more than four (e.g., five, six, etc.) chambers may be used with test stand pipe 105 in some embodiments, with corresponding chamber valves, isolation valves, fluid flow meters, gas flow meters, and the like, positioned as appropriate for the particular application, within the scope of the present disclosure.

Figure 1B:
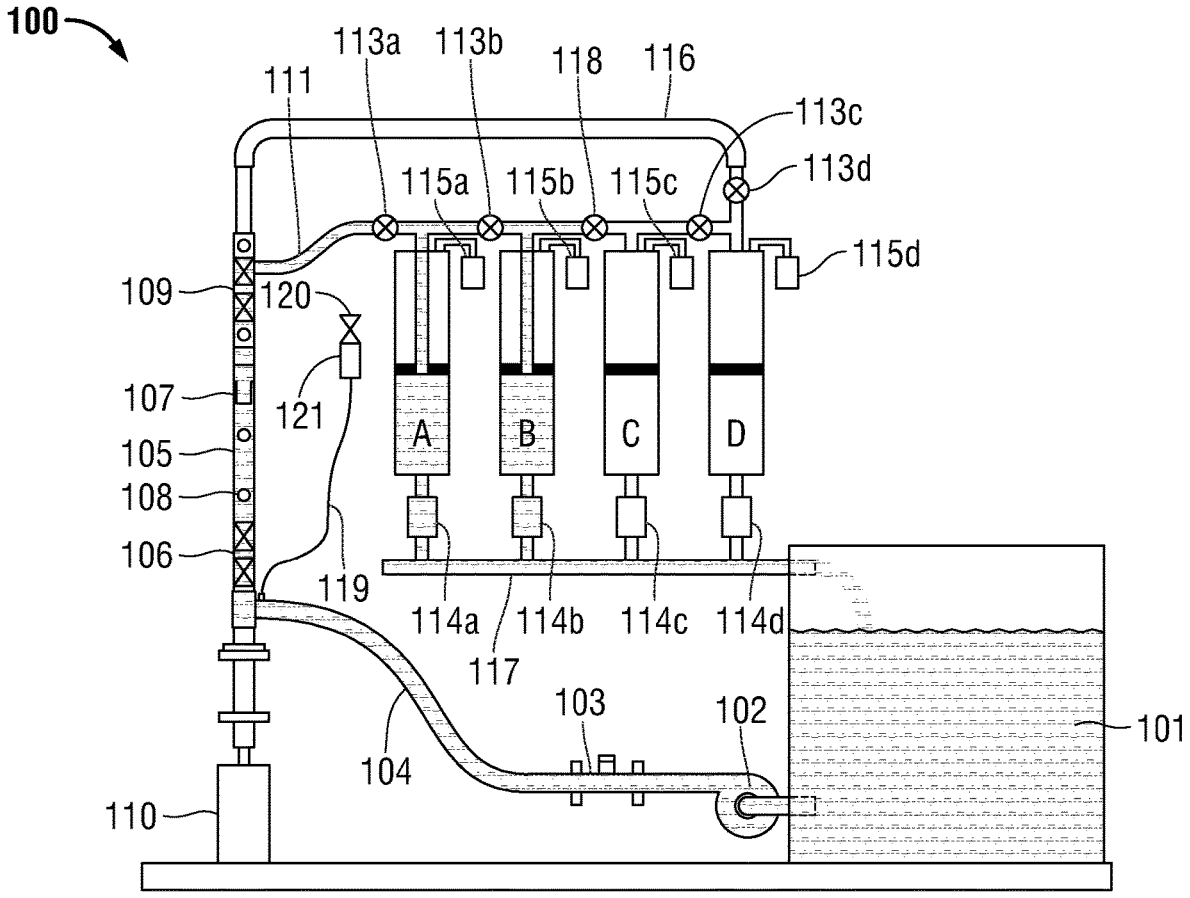

Embodiments of the present disclosure also provide methods of using apparatus 100 to analyze the performance characteristics of specific gas separators and other fluid handling equipment in test stand pipe 105. The methods generally begin when boost pump 102 is activated and fluid is transported from holding tank 101 through system supply line 104 and into test stand pipe 105. This can be seen in FIG. 1B. The rate of flow from holding tank 101 is measured by flow meter 103. Chamber valves 113*a* and 113*b* are opened while isolation valve 118 is closed. Pump 109 and mechanical gas separator 106 are inactive at this time. Fluid from holding tank 101 flows through test stand pipe 105, through gas separator 107, into first chamber supply line 111 and into chambers A and B. The fluid subsequently exits chambers A and B through fluid flow meters 114*a* and 114*b* and returns via return line 117 to holding tank 101, thereby forming a flow loop as indicated in FIG. 1B. The liquid height in chambers A and B may be maintained by controlling the flow rate through system supply line 104.

Next, chamber valves 113*d* and 113*c* are opened in preparation for activation of pump 109. Once valves 113*d* and 113*c* are opened, mechanical gas separator 106 and pump 109 are activated. Mechanical gas separator 106 creates a vortex in the fluid flow through test stand pipe 105. According to embodiments of the disclosure, test stand pipe 105 is made from a transparent material, such as Plexiglas, so that the vortex created by mechanical gas separator 106 can be visually observed, as well as other flow characteristics of the fluid flow through the other components in test stand pipe 105. Visual observation may be particularly useful in understanding the flow regime, which can be affected by factors such as emulsification of the gas in the fluid, or by changes in temperature or pressure, which could require visual observation over a time period. In addition, being able to visually locate the vortex in test stand pipe 105 allows a pressure sensor (not expressly shown) to be inserted in the test stand pipe 105 to obtain data about the vortex itself. One or more resealable holes 108 may be formed at selected locations longitudinally and/or circumferentially along the test stand pipe 105 for inserting the pressure sensor and other sensors into the test stand pipe 105.

Figure 1C:
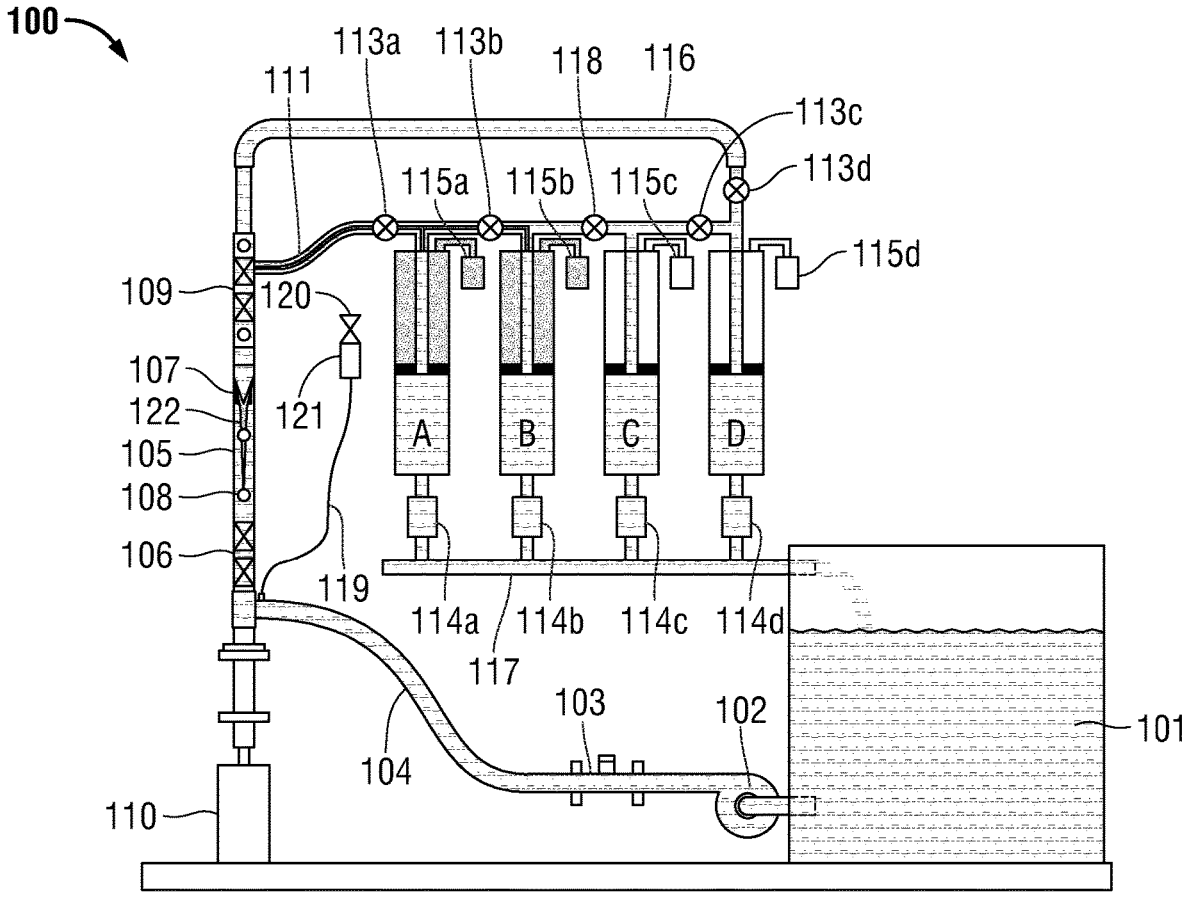

Referring now to FIG. 1C, when pump 109 is activated, fluid begins flowing into second chamber supply line 116. As mentioned, this supply line 116 simulates a well head path from the output of the multistage pump 109 as it would be arranged in actual production operations. The flow from the second chamber supply line 116 is divided among chambers C and D, with valve 118 still closed at this time. The fluid in chambers C and D exits through flow meters 114*c* and 114*d* and returns to holding tank 101 via return line 117, thus forming a second system flow loop. Analysis of the performance characteristics of certain fluid handling equipment, such as pump 109, may be visually conducted at this point. The analysis may determine, for example, how efficiently pump 109 operates under given conditions, such as temperature and pressure, by comparing the amount of flow through the pump 109 versus the amount of flow through flow channel 110. Further, because test stand pipe 105 is preferably made from a clear material, the actual flow regime may be observed during the testing.

Still with reference to FIG. 1C, gas may be added to the fluid to create a two-phase flow to analyze the characteristics of the gas separator 107 and other equipment in the system. Injection valve 120, coupled to a supply of gas (not expressly shown), is slowly opened to allow gas into gas supply line 119 and into test stand pipe 105. An injection flow meter 121 is coupled to gas supply line 119 to measure the flow rate of gas flowing through injection valve 120. Mechanical gas separator 106, a two-stage separator in this example, creates a vortex 122 within test stand pipe 105 that may be seen and analyzed through the transparent material used to construct test stand pipe 105. The vortex helps to mix the injected gas with the fluid to create a two-phase fluid. The two-phase fluid is subsequently separated by gas separator 107. The separated gas is then shunted into the first chamber supply line 111 by gas separator 107. The gas in first chamber supply line 111 is transported into chambers A and B. Subsequently, the gas exits chambers A and B through flow meters 115*a* and 115*b*, which measure the gas flow rates. The gas flow rates measured at flow meters 115*a* and 115*b*, theoretically, should match the flow rate measured at injection flow meter 121.

Figure 1D:
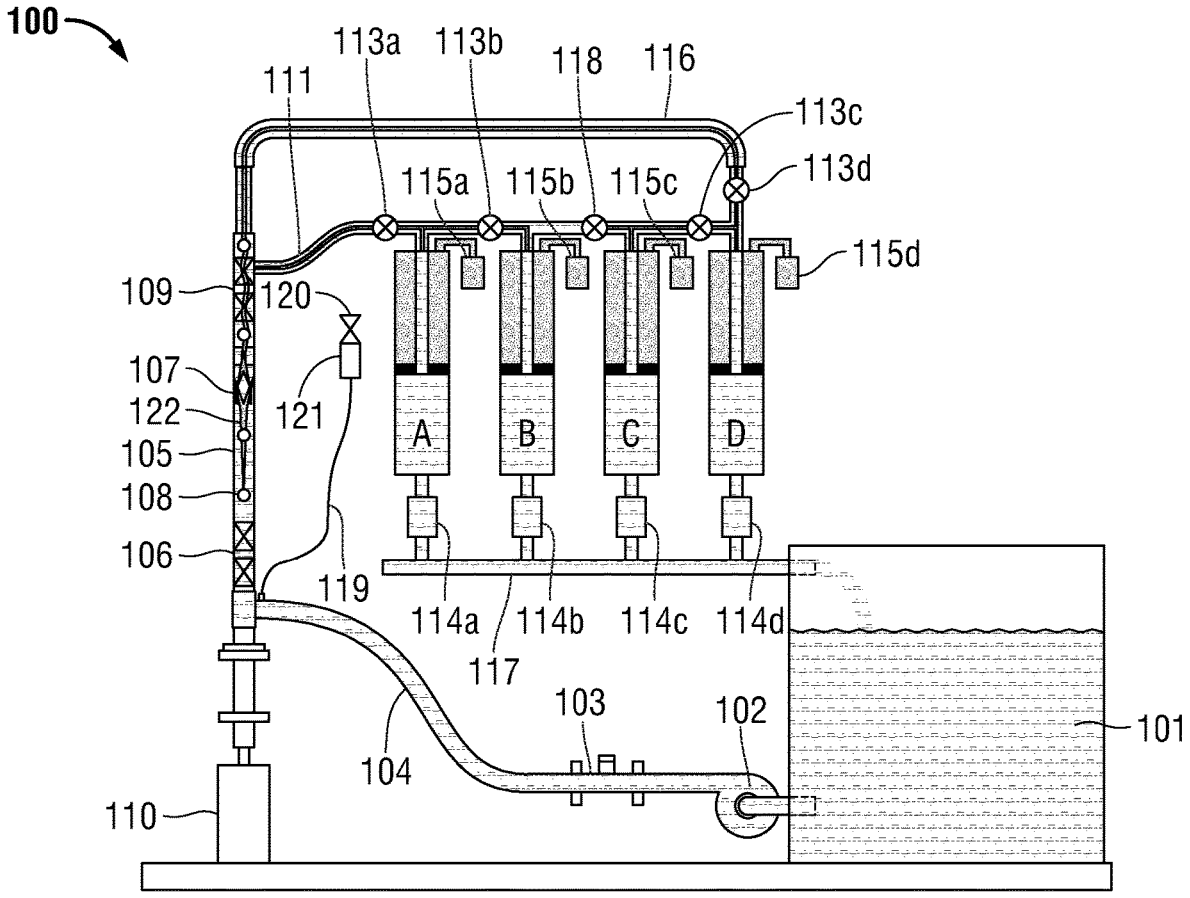

Referring now to FIG. 1D, the gas flow rate through gas supply line 119 may be gradually increased by further opening injection valve 120. The increase in gas enlarges the vortex 122. To understand the performance parameters of the gas handling system, such as the failure limits thereof, the flow of gas may be increased until the gas separator 107 is overloaded and fails to adequately separate all gas from the fluid stream. At this point, gas also begins to travel through the pump 109 in a gas stream 123 into second chamber supply line 116. This gas then travels into chambers C and D, then out through flow meters 115*c* and 115*d*, which measures the gas flow rates therethrough. The amount of gas flowing through pump 109 and second chamber supply line 116 under overload conditions may then be measured and compared to the amount of gas flowing through first chamber supply line 111 for analysis.

While quantitative measurements are, of course, important in embodiments of the disclosure, the test stand pipe 105 as well as chambers A, B, C, and D, first and second chamber supply lines 111 and 116, and/or other components of the apparatus 100 may also be made from a see-through plastic or other material that allows real-time, visual observation of the two-phase flow regime to allow for more accurate study of the internal equipment under test and allows a better understanding of how the internal system components operate.

Figure 2:
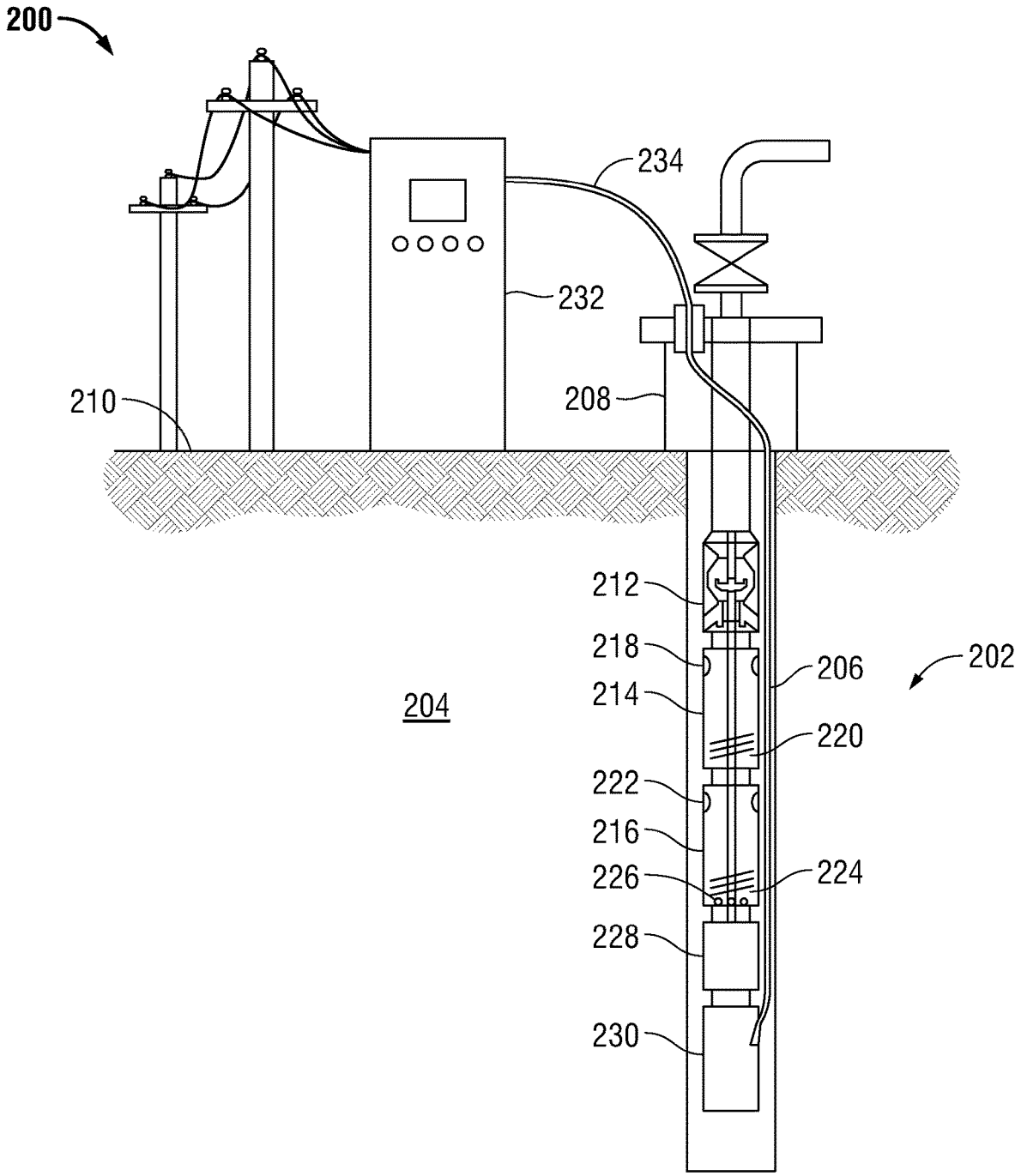
FIG. 2 is a schematic diagram showing an exemplary well site that uses downhole fluid handling systems tested according to embodiments of the disclosure.

Referring now to FIG. 2, a schematic diagram of an exemplary well site 200 is shown in which gas separators that were tested according to embodiments of the present disclosure may be used. As can be seen, a wellbore 202 has been drilled into a subterranean formation 204 at the well site 200 and tubing 206 has been lowered into the wellbore 202. The tubing 206 extends from a wellhead 208 installed at the surface 210 to facilitate production of wellbore fluid from the subterranean formation 204. Production in this example is driven primarily by an electric semisubmersible pump (ESP) 212.

Performance of the ESP 212 can be significantly degraded by the presence of gas in the wellbore fluid. Therefore, an upper gas separator 214 and a lower separator 216 have been provided in the tubing 206 to perform gas separation. Such gas separators 214 and 216 are well known in the art and are thus described only generally here. In general, the upper gas separator 214 includes one or more gas exit ports 218 and a fluid mover 220, and the lower separator 216 likewise includes one or more gas exit ports 222 and a fluid mover 224. Intake ports 226 in the lower gas separator 216 allow wellbore fluid to enter for gas separation. The use of the upper and lower gas separators 214 and 216 in tandem as shown in FIG. 2 has been found to greatly improve gas removal from wellbore fluids compared to a single separator.

Because gas separators 214 and 216 have been tested and analyzed using embodiments of the disclosure, well operators can be confident that the separator exit design properties and effectiveness, and/or any recirculation of fluid from the separator exit to the separator intake and the conditions which create said recirculation, will perform as intended downhole. A motor seal 228 prevents wellbore fluid from contaminating a drive motor 230 that drives the gas separators 214 and 216 and other equipment.

Figure 3:
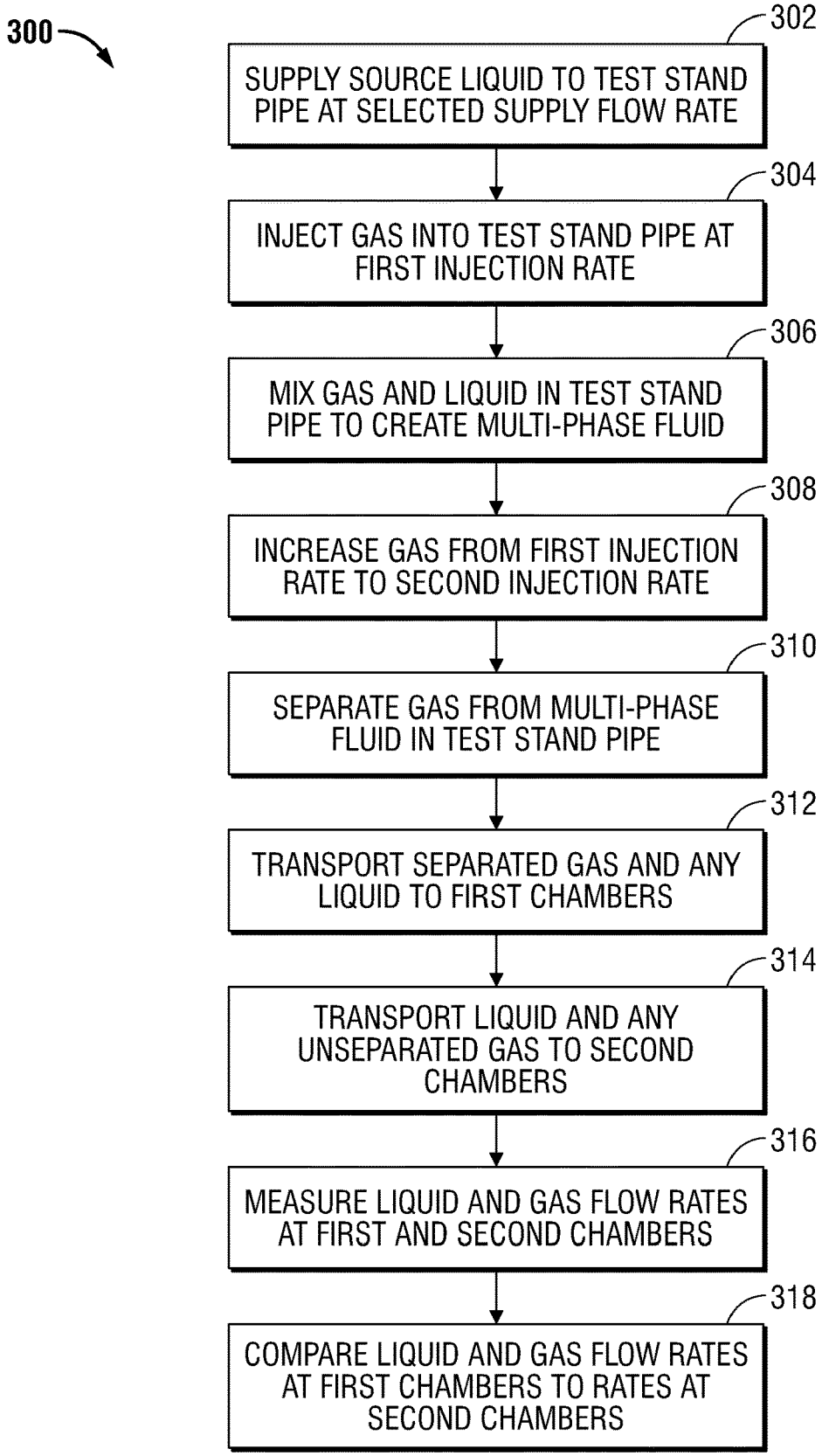
FIG. 3 is a flow diagram showing a method for analyzing fluid flow through downhole fluid handling systems according to embodiments of the present disclosure.

Following now in FIG. 3 is a method 300 that may be used to visually analyze and test fluid handling equipment according to embodiments of the present disclosure. The method 300 generally begins at block 302 where a source liquid from a holding tank is supplied to the test stand pipe at the selected flow rate. As mentioned, the test stand pipe is preferably constructed partly or entirely of a transparent or translucent material. At block 304, gas is injected into the test stand pipe from a gas supply line at the first injection rate. At block 306, the gas and the source liquid are mixed in the test stand pipe to create a multiphase fluid. In some embodiments, the mixing may be done by a mechanical gas separator that generates a vortex in the test stand pipe. At block 308, the injection of gas into the test stand pipe is increased from the first flow rate to a second flow rate.

While the gas is being injected, a gas separator positioned upstream of the mechanical gas separator attempts to separate the gas from the multiphase fluid at block 310. When the gas is injected at the first injection rate, the gas separator is able to separate substantially (e.g., within 10 percent) all the gas from the fluid. However, when the gas injection rate is increased to the second injection rate, the gas separator can no longer separate substantially all gas from the fluid.

At block 312, the gas that was separated by the gas separator is transported along with any liquid to a set of first chambers. The transport may be done using a first chamber supply line that couples the test stand pipe to the set of first chambers. At block 314, any gas that was not separated by the gas separator is pumped by a multistage pump along with the liquid to a set of second chambers. This transport may be done using a second chamber supply line that couples the test stand pipe to the set of second chambers. At block 316, the liquid and gas flow rates at the sets of first and second chambers are measured, for example, using liquid and gas flow meters coupled to liquid and gas outlets at the sets of first and second chambers. At block 318, the liquid and gas flow rates measured at the set of first chambers are compared to the liquid and gas flow rates measured at the set of second chambers for analysis of gas separator performance and characteristics.

In some embodiments, in addition to the test stand pipe, the first and second chamber supply lines and/or the sets of first and second chambers may also be constructed of a transparent or translucent material. Likewise, the gas separator and the multistage pump may have outer housings composed of a transparent or translucent material.

Accordingly, as set forth herein, embodiments of the present disclosure may be implemented in a number of ways. For example, in one aspect, embodiments of the present disclosure relate to an apparatus for characterizing downhole fluid handling systems. The apparatus comprises, among other things, a hollow cylindrical housing arranged to selectively receive a multiphase fluid containing a gas and a liquid therein, the hollow cylindrical housing constructed at least partly of a transparent or translucent material. The apparatus also comprises a gas separator positioned within the hollow cylindrical housing at a specified location, and a multistage pump positioned upstream of the gas separator at a specified location within the hollow cylindrical housing. The apparatus additionally comprises a first chamber supply line coupled to the hollow cylindrical housing between the gas separator and the multistage pump and arranged to transport gas separated by the gas separator and any liquid away from the hollow cylindrical housing, and a second chamber supply line coupled to the hollow cylindrical housing upstream of the multistage pump and arranged to transport liquid and any gas unseparated by the gas separator from the multistage pump away from the hollow cylindrical housing. The apparatus further comprises at least one first chamber coupled to the first chamber supply line and arranged to receive the gas and any liquid transported by the first chamber supply line, and at least one second chamber coupled to the second chamber supply line and arranged to receive the liquid and any gas transported by the second chamber supply line. A liquid flow meter is coupled to each of the at least one first and second chambers, each liquid flow meter arranged to measure a flow rate of liquid at the at least one first and second chambers, respectively, and a gas flow meter is coupled to each of the at least one first and second chambers, each gas flow meter arranged to measure a flow rate of gas at the at least one first and second chambers, respectively.

In accordance with any one or more of the foregoing embodiments, the apparatus further comprises a mechanical separator positioned downstream of the gas separator within the hollow cylindrical housing, the mechanical separator arranged to induce a vortex in the hollow cylindrical housing; and/or a gas supply line coupled to the hollow cylindrical housing and arranged to selectively inject gas into the hollow cylindrical housing.

In accordance with any one or more of the foregoing embodiments, the apparatus further comprises a holding tank and a liquid supply line coupling the holding tank to the hollow cylindrical housing, the liquid supply line arranged to selectively supply liquid from the holding tank to the hollow cylindrical housing; and optionally a return line coupled to each liquid flow meter, the return line arranged to return liquid exiting from the at least one first and second chambers to the holding tank In accordance with any one or more of the foregoing embodiments, a plurality of chamber valves is coupled to the first and second chamber supply lines, each chamber valve individually operable in conjunction with one another to selectively control fluid flow into the at least one first and second chambers; and/or an isolation valve is coupled to the first chamber supply line and operable to selectively isolate the at least one first chamber from the at least one second chamber.

In accordance with any one or more of the foregoing embodiments, the hollow cylindrical housing has one or more resealable holes formed therein, the one or more resealable holes allowing a sensor to be inserted in the hollow cylindrical housing.

In accordance with any one or more of the foregoing embodiments, each of the at least one first and second chambers includes a gas outlet and each gas flow meter is coupled to a respective each gas outlet; and/or each of the at least one first and second chambers includes a liquid outlet and each liquid flow meter is coupled to a respective liquid outlet.

In accordance with any one or more of the foregoing embodiments, the first chamber supply line and the at least one first chamber form a first closed test loop together with the return line, the holding tank, the liquid supply line, and the hollow cylindrical housing; and/or the second chamber supply line and the at least one second chamber form a second closed test loop together with the return line, the holding tank, the liquid supply line, and the hollow cylindrical housing.

In accordance with any one or more of the foregoing embodiments, the gas separator has a transparent or translucent outer housing, and/or the multistage pump has a transparent or translucent outer housing.

In accordance with any one or more of the foregoing embodiments, the first chamber supply line, the second chamber supply line, the at least one first chamber, and/or the at least one second chamber is constructed of a transparent or translucent material.

In general, in another aspect, embodiments of the present disclosure relate to a method for testing fluid handling equipment used in oil and gas production. The method comprises, among other things, supplying a liquid to a hollow cylindrical housing at a selected supply flow rate from a liquid supply line, the hollow cylindrical housing constructed at least partly of a transparent or translucent material. The method also comprises injecting a gas into the hollow cylindrical housing at a first injection rate from a gas supply line, mixing the gas and the liquid to create a multiphase fluid, and increasing injection of gas into the hollow cylindrical housing from the first injection rate to a second injection rate. The method additionally comprises separating the gas in a gas separator positioned within the hollow cylindrical housing, wherein the gas separator separates all the gas injected at the first injection rate from the multiphase fluid, and wherein the gas separator fails to separate all the gas injected at the second injection rate from the multiphase fluid. The method further comprises transporting gas separated by the gas separator and any liquid to at least one first chamber through a first chamber supply line coupled to the hollow cylindrical housing, and transporting liquid and any gas unseparated by the gas separator from a multistage pump to at least one second chamber through a second chamber supply line coupled to the hollow cylindrical housing. A liquid flow rate and a gas flow rate are measured at the at least one first and second chambers, and the liquid flow rate and the gas flow rate at the at least one first chamber are compared to the liquid flow rate and the gas flow rate at the at least one second chamber.

In accordance with any one or more of the foregoing embodiments, the method further comprises inserting a sensor into the hollow cylindrical housing through one or more resealable holes formed therein.

In accordance with any one or more of the foregoing embodiments, mixing the gas and the liquid to create a multiphase fluid is performed by a mechanical separator positioned downstream of the gas separator within the hollow cylindrical housing, the mechanical separator arranged to induce a vortex in the hollow cylindrical housing.

In accordance with any one or more of the foregoing embodiments, the liquid is supplied to the hollow cylindrical housing from a holding tank, the holding arranged to receive liquid from the at least first and second chambers through a return line; the first chamber supply line and the at least one first chamber form a first closed test loop together with the return line, the holding tank, the liquid supply line, and the hollow cylindrical housing; and/or the second chamber supply line and the at least one second chamber form a second closed test loop together with the return line, the holding tank, the liquid supply line, and the hollow cylindrical housing;

In accordance with any one or more of the foregoing embodiments, the gas separator has a transparent or translucent outer housing, and/or the multistage pump has a transparent or translucent outer housing.

In accordance with any one or more of the foregoing embodiments, the first chamber supply line, the second chamber supply line, the at least one first chamber, and/or the at least one second chamber is constructed of a transparent or translucent material.

Further, although reference has been made to uphole and downhole directions, it will be appreciated that this refers to the run-in direction of the tool, and that the tool is useful in horizontal casing run applications, and the use of the terms of uphole and downhole are not intended to be limiting as to the position of the plug assembly within the downhole formation.

While the disclosure has been described with reference to one or more particular embodiments, those skilled in the art will recognize that many changes may be made thereto without departing from the spirit and scope of the description. Each of these embodiments and obvious variations thereof is contemplated as falling within the spirit and scope of the claimed disclosure, which is set forth in the following claims.

What is claimed is:

1. An apparatus for characterizing downhole fluid handling systems, comprising:

a hollow cylindrical housing arranged to selectively receive a multiphase fluid containing a gas and a liquid therein, the hollow cylindrical housing constructed at least partly of a transparent or translucent material;

a gas separator positioned within the hollow cylindrical housing at a specified location;

a multistage pump positioned upstream of the gas separator at a specified location within the hollow cylindrical housing;

a first chamber supply line coupled to the hollow cylindrical housing between the gas separator and the multistage pump and arranged to transport gas separated by the gas separator and any liquid away from the hollow cylindrical housing;

a second chamber supply line coupled to the hollow cylindrical housing upstream of the multistage pump and arranged to transport liquid and any gas unseparated by the gas separator from the multistage pump away from the hollow cylindrical housing;

at least one first chamber coupled to the first chamber supply line and arranged to receive the gas and any liquid transported by the first chamber supply line;

at least one second chamber coupled to the second chamber supply line and arranged to receive the liquid and any gas transported by the second chamber supply line;

a liquid flow meter coupled to each of the at least one first and second chambers, each liquid flow meter arranged to measure a flow rate of liquid at the at least one first and second chambers, respectively; and a gas flow meter coupled to each of the at least one first and second chambers, each gas flow meter arranged to measure a flow rate of gas at the at least one first and second chambers, respectively.

2. The apparatus of claim 1, further comprising a mechanical separator positioned downstream of the gas separator within the hollow cylindrical housing, the mechanical separator arranged to induce a vortex in the hollow cylindrical housing.

3. The apparatus of claim 1, wherein the hollow cylindrical housing has one or more resealable holes formed therein, the one or more resealable holes allowing a sensor to be inserted in the hollow cylindrical housing.

4. The apparatus of claim 1, further comprising a gas supply line coupled to the hollow cylindrical housing and arranged to selectively inject gas into the hollow cylindrical housing.

5. The apparatus of claim 1, wherein each of the at least one first and second chambers includes a gas outlet and each gas flow meter is coupled to a respective each gas outlet.

6. The apparatus of claim 1, wherein each of the at least one first and second chambers includes a liquid outlet and each liquid flow meter is coupled to a respective liquid outlet.

7. The apparatus of claim 6, further comprising a holding tank and a liquid supply line coupling the holding tank to the hollow cylindrical housing, the liquid supply line arranged to selectively supply liquid from the holding tank to the hollow cylindrical housing.

8. The apparatus of claim 7, further comprising a return line coupled to each liquid flow meter, the return line arranged to return liquid exiting from the at least one first and second chambers to the holding tank.

9. The apparatus of claim 8, wherein the first chamber supply line and the at least one first chamber form a first closed test loop together with the return line, the holding tank, the liquid supply line, and the hollow cylindrical housing, and/or wherein the second chamber supply line and the at least one second chamber form a second closed test loop together with the return line, the holding tank, the liquid supply line, and the hollow cylindrical housing.

10. The apparatus of claim 1, further comprising a plurality of chamber valves coupled to the first and second chamber supply lines, each chamber valve individually operable in conjunction with one another to selectively control fluid flow into the at least one first and second chambers.

11. The apparatus of claim 1, further comprising an isolation valve coupled to the first chamber supply line and operable to selectively isolate the at least one first chamber from the at least one second chamber.

12. The apparatus of claim 1, wherein the gas separator has a transparent or translucent outer housing, and/or the multistage pump has a transparent or translucent outer housing.

13. The apparatus of claim 1, wherein the first chamber supply line, the second chamber supply line, the at least one first chamber, and/or the at least one second chamber is constructed of a transparent or translucent material.

14. A method for testing fluid handling equipment used in oil and gas production, comprising:

supplying a liquid to a hollow cylindrical housing at a selected supply flow rate from a liquid supply line, the hollow cylindrical housing constructed at least partly of a transparent or translucent material;

injecting a gas into the hollow cylindrical housing at a first injection rate from a gas supply line;

mixing the gas and the liquid to create a multiphase fluid;

increasing injection of gas into the hollow cylindrical housing from the first injection rate to a second injection rate;

separating the gas in a gas separator positioned within the hollow cylindrical housing, wherein the gas separator separates all the gas injected at the first injection rate from the multiphase fluid, and wherein the gas separator fails to separate all the gas injected at the second injection rate from the multiphase fluid;

transporting gas separated by the gas separator and any liquid to at least one first chamber through a first chamber supply line coupled to the hollow cylindrical housing;

transporting liquid and any gas unseparated by the gas separator from a multistage pump to at least one second chamber through a second chamber supply line coupled to the hollow cylindrical housing;

measuring a liquid flow rate and a gas flow rate at the at least one first and second chambers; and comparing the liquid flow rate and the gas flow rate at the at least one first chamber to the liquid flow rate and the gas flow rate at the at least one second chamber.

15. The method of claim 14, wherein mixing the gas and the liquid to create a multiphase fluid is performed by a mechanical separator positioned downstream of the gas separator within the hollow cylindrical housing, the mechanical separator arranged to induce a vortex in the hollow cylindrical housing.

16. The method of claim 14, further comprising inserting a sensor into the hollow cylindrical housing through one or more resealable holes formed therein.

17. The method of claim 14, wherein the liquid is supplied to the hollow cylindrical housing from a holding tank, the holding arranged to receive liquid from the at least first and second chambers through a return line.

18. The method of claim 17, wherein the first chamber supply line and the at least one first chamber form a first closed test loop together with the return line, the holding tank, the liquid supply line, and the hollow cylindrical housing, and/or wherein the second chamber supply line and the at least one second chamber form a second closed test loop together with the return line, the holding tank, the liquid supply line, and the hollow cylindrical housing.

19. The method of claim 14, wherein the gas separator has a transparent or translucent outer housing, and/or the multistage pump has a transparent or translucent outer housing.

20. The method of claim 14, wherein the first chamber supply line, the second chamber supply line, the at least one first chamber, and/or the at least one second chamber is constructed of a transparent or translucent material.

* * * * *